US009464521B2

(12) United States Patent
Logan et al.

(10) Patent No.: US 9,464,521 B2
(45) Date of Patent: Oct. 11, 2016

(54) FLUID PRESSURE PULSE GENERATING APPARATUS WITH PRESSURE COMPENSATION DEVICE AND PULSER ASSEMBLY HOUSING

(71) Applicant: Evolution Engineering Inc., Calgary (CA)

(72) Inventors: Justin C. Logan, Calgary (CA); Aaron W. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

(21) Appl. No.: 14/767,354

(22) PCT Filed: Feb. 11, 2014

(86) PCT No.: PCT/CA2014/050092

§ 371 (c)(1),
(2) Date: Aug. 12, 2015

(87) PCT Pub. No.: WO2014/124530

PCT Pub. Date: Aug. 21, 2014

(65) Prior Publication Data

US 2015/0369041 A1 Dec. 24, 2015

Related U.S. Application Data

(60) Provisional application No. 61/763,640, filed on Feb. 12, 2013.

(51) Int. Cl.

| | |
|---|---|
| ***E21B 47/18*** | (2012.01) |
| ***E21B 7/24*** | (2006.01) |
| ***E21B 7/04*** | (2006.01) |

(52) U.S. Cl.

CPC ..... *E21B 47/18* (2013.01); *E21B 7/04* (2013.01); *E21B 7/24* (2013.01)

(58) Field of Classification Search

CPC .... E21B 47/18; E21B 47/185; E21B 47/187; E21B 7/04; E21B 7/24

See application file for complete search history.

(56) References Cited

U.S. PATENT DOCUMENTS

| | | | |
|---|---|---|---|
| 4,876,672 | A | 10/1989 | Petermann et al. |
| 6,970,398 | B2 | 11/2005 | Lavrut et al. |

(Continued)

FOREIGN PATENT DOCUMENTS

| | | |
|---|---|---|
| CA | 2551316 | 12/2007 |
| GB | 2156915 | 10/1985 |

(Continued)

OTHER PUBLICATIONS

International Search Report and Written Opinion dated Apr. 28, 2014, in PCT/CA2014/050092.

(Continued)

*Primary Examiner* — Brad Harcourt
(74) *Attorney, Agent, or Firm* — Hovey Williams LLP

(57) ABSTRACT

A fluid pressure pulse generating apparatus with a pulser assembly having a pulser assembly housing enclosing a pressure compensation device. The pulser assembly housing includes an interior wall with a plurality of primary apertures therethrough and an exterior wall with a plurality of secondary apertures therethrough, the exterior wall overlying the interior wall. The primary and secondary apertures are in fluid communication with a pressure compensation mechanism in the pressure compensation device such that drilling fluid contacts the pressure compensation mechanism for equalization of pressure of a lubrication liquid contained inside the pulser assembly housing with pressure of the drilling fluid when the fluid pressure pulse generating apparatus is positioned downhole.

33 Claims, 5 Drawing Sheets

(56) References Cited

U.S. PATENT DOCUMENTS

| | | | | |
|---|---|---|---|---|
| 7,564,741 | B2 | 7/2009 | Pratt et al. | |
| 8,203,908 | B2 | 6/2012 | Pratt et al. | |
| 2005/0199423 | A1 | 9/2005 | Moriarty | |
| 2005/0231383 | A1 | 10/2005 | Pratt et al. | |
| 2007/0008377 | A1 | 1/2007 | Jia et al. | |
| 2009/0133930 | A1 | 5/2009 | Thorp et al. | |
| 2010/0025111 | A1 * | 2/2010 | Gearhart | E21B 47/18 175/48 |
| 2012/0127829 | A1 | 5/2012 | Sitka | |

FOREIGN PATENT DOCUMENTS

| | | |
|---|---|---|
| GB | 2411676 | 7/2005 |
| WO | 2005084281 | 9/2005 |
| WO | 2006130606 | 12/2006 |
| WO | 2010138961 | 12/2010 |
| WO | 2012130936 | 10/2012 |
| WO | 2012145637 | 10/2012 |

OTHER PUBLICATIONS

International Preliminary Report on Patentability dated Jan. 22, 2015, in PCT/CA2014/050092.

EP Search Report dated Feb. 22, 2016, in the EP 13866031.1 application filed Dec. 20, 2013.

EP Search Report dated Feb. 22, 2016, in EP 15177783.6 filed Dec. 20, 2013.

EP Search Report dated Feb. 22, 2016, in EP 15177784 filed Dec. 20, 2013.

* cited by examiner

FLUID PRESSURE PULSE GENERATING APPARATUS WITH PRESSURE COMPENSATION DEVICE AND PULSER ASSEMBLY HOUSING

RELATED APPLICATIONS

This is a national stage application under 35 U.S.C. §371 of International Application No. PCT/CA2014/050092, filed Feb. 11, 2014, which claims benefit of U.S. Provisional Patent Application No. 61/763,640, filed Feb. 12, 2013, both of which are hereby incorporated by reference in their entireties.

FIELD

This invention relates generally to downhole drilling, such as measurement-while-drilling (MWD), including a fluid pressure pulse generating apparatus with a pulser assembly having a pulser assembly housing enclosing a pressure compensation device, and a pulser assembly housing for such apparatus.

BACKGROUND

The recovery of hydrocarbons from subterranean zones relies on the process of drilling wellbores. The process includes drilling equipment situated at surface and a drill string extending from the surface equipment to the formation or subterranean zone of interest. The drill string can extend thousands of meters below the surface. The terminal end of the drill string includes a drill bit for drilling (or extending) the wellbore. In addition to this conventional drilling equipment the system also relies on some sort of drilling fluid, which in most cases is a drilling "mud" which is pumped through the inside of the drill string. The drilling mud cools and lubricates the drill bit and then exits out of the drill bit and carries rock cuttings back to surface. The mud also helps control bottom hole pressure and prevents hydrocarbon influx from the formation into the wellbore, which can potentially cause a blow out at surface.

Directional drilling is the process of steering a well away from vertical to intersect a target endpoint or follow a prescribed path. At the terminal end of the drill string is a bottom-hole-assembly ("BHA") which comprises 1) a drill bit; 2) a steerable downhole mud motor of rotary steerable system; 3) sensors of survey equipment (logging-while-drilling (LWD) and/or measurement-while-drilling (MWD)) to evaluate downhole conditions as well depth progresses; 4) equipment for telemetry of data to surface; and 5) other control mechanisms such as stabilizers or heavy weight drill collars. The BHA is conveyed into the wellbore by a metallic tubular.

MWD equipment is used to provide downhole sensor and status information to surface in a near real time mode while drilling. This information is used by the rig crew to make decisions about controlling and steering the well to optimize drilling speed and trajectory based on numerous factors including lease boundaries, location of existing wells, formation properties, and hydrocarbon size and location. This can include making intentional deviations from an originally-planned wellbore path as necessary based on information gathered from the downhole sensors during the drilling process. The ability to obtain real time data during MWD results in a relatively more cost effective and efficient drilling operation.

Known MWD tools contain essentially the same sensor package to survey the wellbore, however the data may be sent back to surface by various telemetry methods. Such telemetry methods include, but are not limited to the use of a hardwired drill pipe, acoustic telemetry, use of a fibre optic cable, mud pulse (MP) telemetry and electromagnetic (EM) telemetry. The sensors are usually located in an electronics probe or instrumentation assembly contained in a cylindrical cover or housing located near the drill bit.

MP telemetry involves creating pressure waves in the drilling mud circulating inside the drill string. Mud circulates from surface to downhole using positive displacement pumps. The resulting flow rate of mud is typically constant. Pressure pulses are generated by changing the flow area and/or flow path of the drilling mud as it passes the MWD tool in a timed, coded sequence, thereby creating pressure differentials in the drilling mud. The pressure differentials or pulses may be either negative pulses or positive pulses. Valves that open and close a bypass mud stream from inside the drill pipe to the wellbore annulus create a negative pressure pulse. All negative pulsing valves need a high differential pressure below the valve to create a sufficient pressure drop when the valve is open, but this results in negative valves being more prone to washing. With each actuation, the valve hits against the valve seat to ensure it completely closes the bypass; this impact can lead to mechanical and abrasive wear and failure. Valves that use a controlled restriction within the circulating mud stream create a positive pressure pulse. Some positive pulsing valves are hydraulically powered to reduce the required actuation power and typically have a main valve indirectly operated by a pilot valve. The pilot valve closes a flow restriction which actuates the main valve to create a pressure drop. Pulse frequency is typically governed by pulse generating motor speed changes. The pulse generating motor requires electrical connectivity with other elements of the MWD probe such as a battery stack and sensors.

In mud pulser systems, as well as in other downhole tools, the pulse generating motor driveline system is subjected to extreme pressure differentials of about 20,000 psi between external and internal aspects of the tool. To accommodate this large pressure differential, the drilling mud has access to areas of the tool which are positioned on one side of a pressure compensation mechanism. Pressure is equalized on the other side of the pressure compensation mechanism within the tool using clean, non-drilling fluid such as hydraulic fluid or silicon oil. Various mechanisms have been used to provide pressure compensation including metallic bellows, rubber compensation membranes, and piston compensation with springs. Given the large temperature differentials from surface to downhole, especially in colder drilling climates, there is a high chance of temperature related failures for MWD tool components, in particular rubber membranes used for pressure compensation.

A pressure compensation device described in WO 2012/130936 utilizes pistons and fluid to provide pressure compensation via a dual section chamber within a housing. The device allows fluid communication through borehole ports to prevent collapse or bulging of the pressure compensation device resulting from thermal expansion of the hydraulic fluid contained in one of the sections of the chamber. The pressure compensation device described in WO 2010/138961 includes a metal membrane that can accommodate large oil volumes. The metal membrane is capable of elastic deformation and is shaped to optimize such deformation in a desired manner to compensate for temperature and pressure effects experienced downhole. U.S. Pat. No. 8,203,908 describes a mud pulser system in which the spline shaft is surrounded by lubricating fluid which is pressurized against downhole hydrostatic pressure using a bellows style pressure compensator. In addition to a bellows seal, the system has a dual seal which maintains the integrity of the lubrication chamber during operation and replacement of the bellows seal during maintenance.

SUMMARY

According to one aspect of the invention, there is provided a fluid pressure pulse generating apparatus for downhole drilling comprising a fluid pressure pulse generator and a pulser assembly. The pulser assembly comprises a pulser assembly housing; a motor and a driveshaft enclosed by the pulser assembly housing, the driveshaft extending from the motor out of the pulser assembly housing and coupling with the fluid pressure pulse generator; a seal surrounding a portion of the driveshaft and configured to seal against the driveshaft to prevent drilling fluid from entering the pulser assembly housing and lubrication liquid from leaving the pulser assembly housing when the fluid pressure pulse generating apparatus is positioned downhole; and a pressure compensation device enclosed by the pulser assembly housing and comprising a pressure compensation mechanism providing a fluid barrier between the lubricating liquid on a first side of the pressure compensation mechanism and the drilling fluid on an opposed second side of the pressure compensation mechanism when the fluid pressure pulse generating apparatus is positioned downhole, the pressure compensation mechanism configured to allow pressure equalization between the lubrication liquid on the first side and the drilling fluid on the second side of the pressure compensation mechanism. The pulser assembly housing comprises an interior wall with a plurality of primary apertures therethrough and an exterior wall with a plurality of secondary apertures therethrough, the exterior wall overlying the interior wall. The primary apertures and the secondary apertures are in fluid communication with the pressure compensation mechanism such that the drilling fluid contacts the second side of the pressure compensation mechanism when the fluid pressure pulse generating apparatus is positioned downhole.

There may be a gap between the interior wall and the exterior wall. The secondary apertures may be offset from the underlying primary apertures.

The apparatus may further comprise a longitudinally extending drilling fluid chamber between the interior wall and the second side of the pressure compensation mechanism, the drilling fluid chamber being in fluid communication with the plurality of primary and secondary apertures.

The pulser assembly housing may comprise: a pressure compensated housing comprising the interior wall; and a sleeve surrounding the interior wall and comprising the exterior wall. The sleeve may be removable from the pressure compensated housing.

The apparatus may further comprise a retention device for retaining the sleeve in position on the pressure compensated housing. The retention device may be a cap configured to mate with the pressure compensated housing. The cap may comprise a threaded internal surface and the pressure compensated housing may comprise a correspondingly threaded external surface portion for removably securing the cap on the pressure compensated housing. Alternatively, the retention device may be incorporated in the sleeve. A portion of the sleeve may comprise a threaded internal surface and a portion of the pressure compensated housing may comprise a correspondingly threaded external surface for retaining the sleeve on the pressure compensated housing.

A diameter of the sleeve may be greater than a diameter of the pressure compensated housing such that an external surface of the sleeve projects above an external surface of the pressure compensated housing.

The pressure compensated housing may comprise a body section and a sleeve receiving section that receives the sleeve thereon, the sleeve receiving section including the plurality of primary apertures therethrough and being of reduced diameter compared to the body section such that the external surface of the sleeve is flush with the external surface of the body section. The sleeve receiving section may comprise an aperture area including the plurality of primary apertures therethrough and a non-aperture area, the aperture area being of reduced diameter compared to the non aperture area. The apparatus may further comprise a cap for retaining the sleeve in position over the sleeve receiving section and the pressure compensated housing may further comprise a cap receiving section that receives the cap. The cap receiving section may be of reduced diameter compared to the body section such that the external surface of the cap is flush with the external surface of the body section. The cap may comprise a threaded internal surface and the cap receiving section may comprise a correspondingly threaded external surface for securing the cap on the pressure compensated housing.

According to another aspect of the invention, there is provided a pulser assembly housing for a pulser assembly of a fluid pressure pulse generating apparatus. The pulser assembly housing comprises an interior wall with a plurality of primary apertures therethrough and an exterior wall with a plurality of secondary apertures therethrough. The exterior wall overlies the interior wall and the primary apertures and the secondary apertures are in fluid communication.

There may be a gap between the interior wall and the exterior wall. The secondary apertures may be offset from the underlying primary apertures.

The pulser assembly housing may comprise: a pressure compensated housing comprising the interior wall; and a sleeve surrounding the interior wall and comprising the exterior wall. The sleeve may be removable from the pressure compensated housing.

The pulser assembly housing may further comprise a retention device for retaining the sleeve in position on the pressure compensated housing. The retention device may be a cap configured to mate with the pressure compensated housing. The cap may comprise a threaded internal surface and the pressure compensated housing may comprise a correspondingly threaded external surface portion for removably securing the cap on the pressure compensated housing.

The retention device may be incorporated in the sleeve. A portion of the sleeve may comprise a threaded internal surface and a portion of the pressure compensated housing may comprise a correspondingly threaded external surface for retaining the sleeve on the pressure compensated housing.

A diameter of the sleeve may be greater than a diameter of the pressure compensated housing such that an external surface of the sleeve projects above an external surface of the pressure compensated housing.

The pressure compensated housing may comprise a body section and a sleeve receiving section that receives the sleeve thereon, the sleeve receiving section including the plurality of primary apertures therethrough and being of reduced diameter compared to the body section such that the external surface of the sleeve is flush with the external surface of the body section. The sleeve receiving section may comprise an aperture area including the plurality of primary apertures therethrough and a non-aperture area, the aperture area being of reduced diameter compared to the non-aperture area. The pressure compensated housing may further comprise a cap receiving section for receiving a cap to retain the sleeve in position over the sleeve receiving section, the cap receiving section being of reduced diameter compared to the body section such that the external surface of the cap is flush with the external surface of the body section when the cap is received on the cap receiving section. The cap receiving section may comprise a threaded external surface that corresponds with a threaded internal surface of the cap for securing the cap on the pressure compensated housing.

According to another aspect of the invention, there is provided a sleeve for surrounding a portion of a housing of a pulser assembly of a fluid pressure pulse generating apparatus, the housing having a plurality of housing apertures therethrough. The sleeve comprises a tubular walled body with a plurality of sleeve apertures therethrough whereby the housing apertures and the sleeve apertures are in fluid communication when the sleeve is positioned on the housing.

The sleeve may further comprise a retention device for retaining the sleeve on the housing. A portion of the sleeve may comprise a threaded internal surface for engaging a correspondingly threaded external surface portion of the housing to removably retain the sleeve on the housing.

DETAILED DESCRIPTION

The embodiments described herein generally relate to an apparatus or tool having a fluid pressure pulse generator. The tool is typically a MWD tool or probe which may be used for MP telemetry in downhole drilling. The tool may alternatively be used in other methods where it is necessary to generate a fluid pressure pulse.

Figure 1:
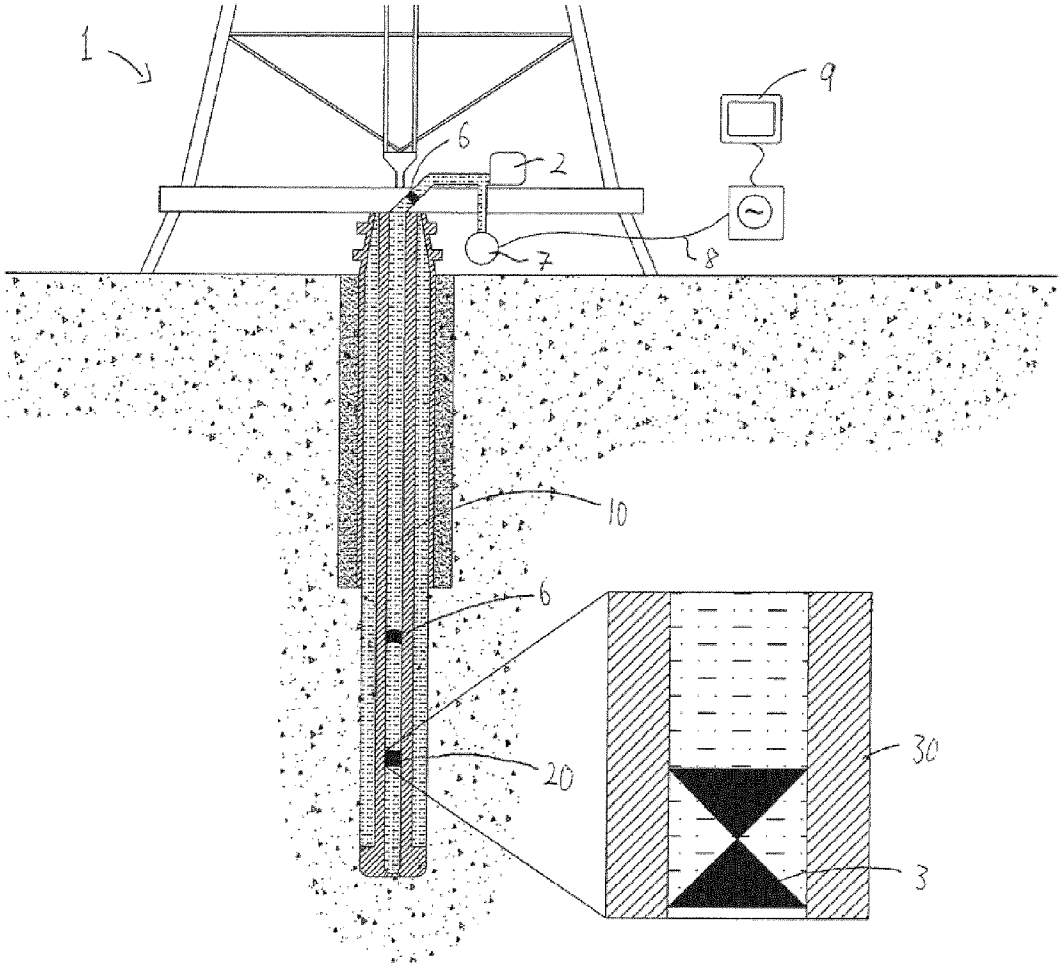
FIG. 1 is a schematic of a MP telemetry method in a drill string of an oil or gas borehole using a MWD telemetry tool in accordance with embodiments of the invention.

Referring to the drawings and specifically to FIG. 1, there is shown a schematic representation of a MP telemetry method using a MWD tool according to embodiments of the invention. In downhole drilling equipment 1, drilling fluid or "mud" is pumped down a drill string by pump 2 and passes through the MWD tool 20. The MWD tool 20 includes a fluid pressure pulse generator 30 including valve 3 which generates positive fluid pressure pulses (represented schematically as pressure pulse 6). Information acquired by downhole sensors (not shown) is transmitted in specific time divisions by the pressure pulses 6 in mud column 10. More specifically, signals from sensor modules in the MWD tool 20 or in another probe (not shown) are received and processed in a data encoder in the MWD tool 20 where the data is digitally encoded as is well established in the art. This data is sent to a controller in the MWD tool 20 which then actuates the fluid pressure pulse generator 30 to generate pressure pulses 6 which contain the encoded data. The pressure pulses 6 are transmitted to surface and detected by a surface pressure transducer 7. The surface pressure transducer 7 converts the detected pressure pulses 6 into electrical signals that are sent through transducer cable 8 to a surface computer 9. The computer 9 decodes the electrical signals and displays the transmitted information which can be used by a drilling operator.

Characteristics of the pressure pulses 6 are defined by amplitude, duration, shape, and frequency, and these characteristics are used in various encoding systems to represent binary data. One or more signal processing technique is used to separate undesired mud pump noise, rig noise or downward propagating noise from transmitted MWD signals as is known in the art. The data transmission rate is governed by Lamb's theory for acoustic waves in drilling mud and is approximately 1.1 to 1.5 km/s. The fluid pressure pulse generator 30 must operate in an unfriendly environment with high static downhole pressures, high temperatures and high fluid flow rates. The fluid pressure pulse generator 30 generates pressure pulses 6 between 100-300 psi and typically operates in a mud flow rate dictated by the size of the drill pipe bore and limited by surface pumps, drill bit total flow area (TFA), and mud motor/turbine differential requirements for drill bit rotation.

Figure 2:
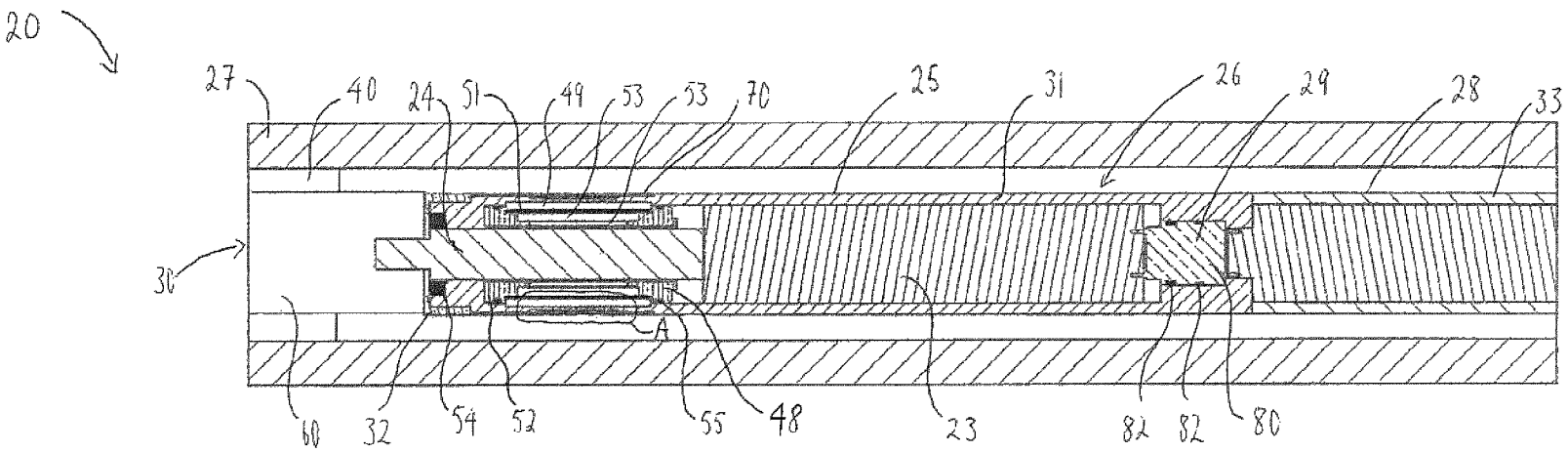
FIG. 2 is a longitudinally sectioned view of a mud pulser section of the MWD tool comprising a pressure compensation device enclosed in a pressure compensated housing and sleeve according to an embodiment of the invention.

Referring to FIG. 2, the mud pulser section of the MWD tool 20 is shown in more detail and generally comprises the fluid pressure pulse generator 30 and a pulser assembly 26 that drives the fluid pressure pulse generator 30. The fluid pressure pulse generator 30 and pulser assembly 26 are axially located inside a drill collar 27 with an annular gap therebetween for flow of drilling mud. The fluid pressure pulse generator 30 generally comprises a stator 40 and a rotor 60. The stator 40 is fixed to the drill collar 27 and the rotor 60 is fixed to a driveshaft 24 of the pulser assembly 26. In alternative embodiments (not shown), different fluid pressure pulse generators as would be known in the art may be utilized and the innovative aspects of the invention apply equally in embodiments such as these.

The pulser assembly 26 includes a motor subassembly 25 and an electronics subassembly 28. The motor subassembly 25 includes a pressure compensated housing 31 enclosing pulse generating motor and gearbox 23, driveshaft 24, and a pressure compensation device 48. The driveshaft 24 is attached to the pulse generating motor and gearbox 23, and the pressure compensation device 48 surrounds a portion of the driveshaft 24. The electronics subassembly 28 includes an electronics housing 33 surrounding control electronics and other components (not shown) required by the MWD tool 20 to receive direction and inclination information and measurements of drilling conditions and encode this information and measurements into telemetry data as is known in the art. The electronics housing 33 has a low pressure (approximately atmospheric) internal environment suitable for the internal components of the electronics subassembly 28. The telemetry data is converted into motor control signals that are sent from the electronics subassembly 28 to the pulse generating motor and gearbox 23. The pulse generating motor and gearbox 23 rotates the driveshaft 24 and rotor 60 in a controlled pattern based on the motor control signals and generates pressure pulses 6 representing the telemetry data that are transmitted to surface as described above.

The motor subassembly 25 and the electronics subassembly 28 are physically and electronically coupled together by a feed-through connector 29. Feed through connector 29 is a typical connector known in the art and is generally pressure rated to withstand the pressure differential between the low-pressure electronics subassembly 28 (approximately atmospheric pressure) and the pressure compensated motor subassembly 25 where pressures can reach 20,000 psi. The feed through connector 29 comprises a body 80 having a generally cylindrical shape with a high pressure end facing the motor subassembly 25 and a low pressure end facing the electronics subassembly 28. Sealing O-rings 82 are provided on the external surface of the body 80 to ensure a fluid seal is established between the body 80 and the pressure compensated housing 31 of the motor subassembly 25. Electrical interconnections extend axially through the length of the body 80 of the feed through connector 29; these electrical interconnections include electric motor interconnects which transmit power and control signals between components in the electronics subassembly 28 and the pulse generating motor and gearbox 23 in the motor subassembly 25.

The motor subassembly 25 is filled with a lubrication liquid such as hydraulic oil or silicon oil; this lubrication liquid is fluidly separated from drilling mud flowing external to the pulser assembly 26 by seal 54. The pressure compensation device 48 equalizes the pressure of lubrication liquid inside the motor subassembly 25 with the pressure of drilling mud in the external vicinity of the pulser assembly 26. Without pressure compensation, it would be difficult for the driveshaft 24 to rotate due to an excessive pressure differential between the internal lubrication liquid and the external drilling mud. The torque required to rotate the driveshaft 24 without pressure compensation would need high current draw and would lead to excessive battery consumption and increased costs. The seal 54 may be a standard polymer lip seal provided at the downhole end of driveshaft 24 and is enclosed by the pressure compensated housing 31 of the motor subassembly 25. The seal 54 allows rotation of the driveshaft 24 while preventing mud from entering the pressure compensated housing 31 and lubrication liquid from leaking out of the pressure compensated housing 31.

The pressure compensation device 48 is a generally tubular device that extends around a portion of the driveshaft 24 and is enclosed by the pressure compensated housing 31 of the motor subassembly 25. The pressure compensation device 48 comprises a generally cylindrical flexible membrane 51 supported by a membrane support 52. The support 52 is a generally cylindrical structure with a central bore that allows the driveshaft 24 to extend therethrough. The support 52 has two end sections with an outer diameter that abuts against the inside surface of the pressure compensated housing 31. O-ring seals 55 provide a fluid seal between the pressure compensated housing 31 and the end sections. The end sections each have a membrane mount for mounting respective ends of the membrane 51. Extending between the end sections of the support 52 and internal to the membrane 51 are a plurality of longitudinally extending lubrication liquid pressure compensation chambers 53 that are filled with lubrication liquid.

Figure 5:
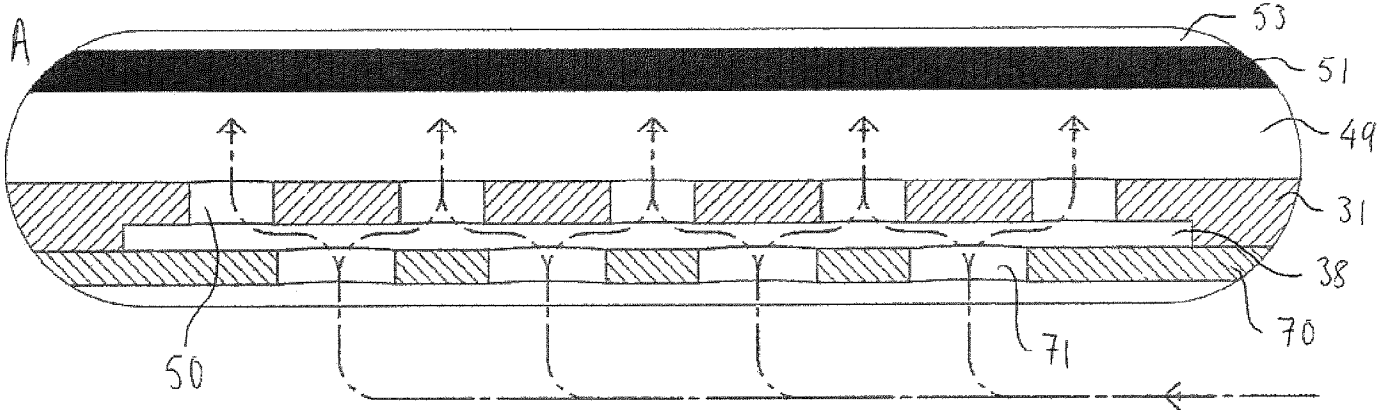
FIG. 5 is a close up longitudinally sectioned view of A in FIG. 2 showing part of the pressure compensation device, pressure compensated housing and sleeve of the MWD tool.

Referring now to FIG. 5, the pressure compensated housing 31 of the motor subassembly 25 includes a plurality of primary apertures 50 extending radially through the housing wall. A sleeve 70 is positioned around a portion of the pressure compensated housing 31 and held in place on the pressure compensated housing 31 by a retention cap 32 (as shown in FIG. 2). The sleeve 70 overlies primary apertures 50 and includes a plurality of secondary apertures 71 therethrough that are offset from the primary apertures 50. A longitudinally extending drilling fluid pressure compensation chamber 49 extends between the end sections of support 52 and is bound on one side by the pressure compensated housing 31 and on the other side by the membrane 51 of the pressure compensation device 48. The drilling fluid pressure compensation chamber 49 is in fluid communication with the primary apertures 50 of the pressure compensated housing 31 and the secondary apertures 71 of the sleeve 70, such that externally flowing drilling mud flows into the chamber 49 via the secondary and primary apertures 71, 50 as represented by arrows in FIG. 2. The membrane 51 provides a fluid barrier between the drilling mud in the drilling fluid pressure compensation chamber 49 and the lubrication liquid in the lubrication liquid pressure compensation chamber 53. The membrane 51 may be made of a flexible polymer, for example, but not limited to, rubber or fluorocarbons (for example Viton™) that is able to flex to compensate for pressure changes in the drilling mud and allows the pressure of the lubrication liquid inside the motor subassembly 25 to substantially equalize with the pressure of the external drilling mud. In alternative embodiments (not shown), the pressure compensation device need not be a flexible polymer membrane device and may be any pressure compensation device known in the art, such as pressure compensation devices that utilize pistons, metal membranes, or a bellows style pressure compensation mechanism as described above.

Figure 3:
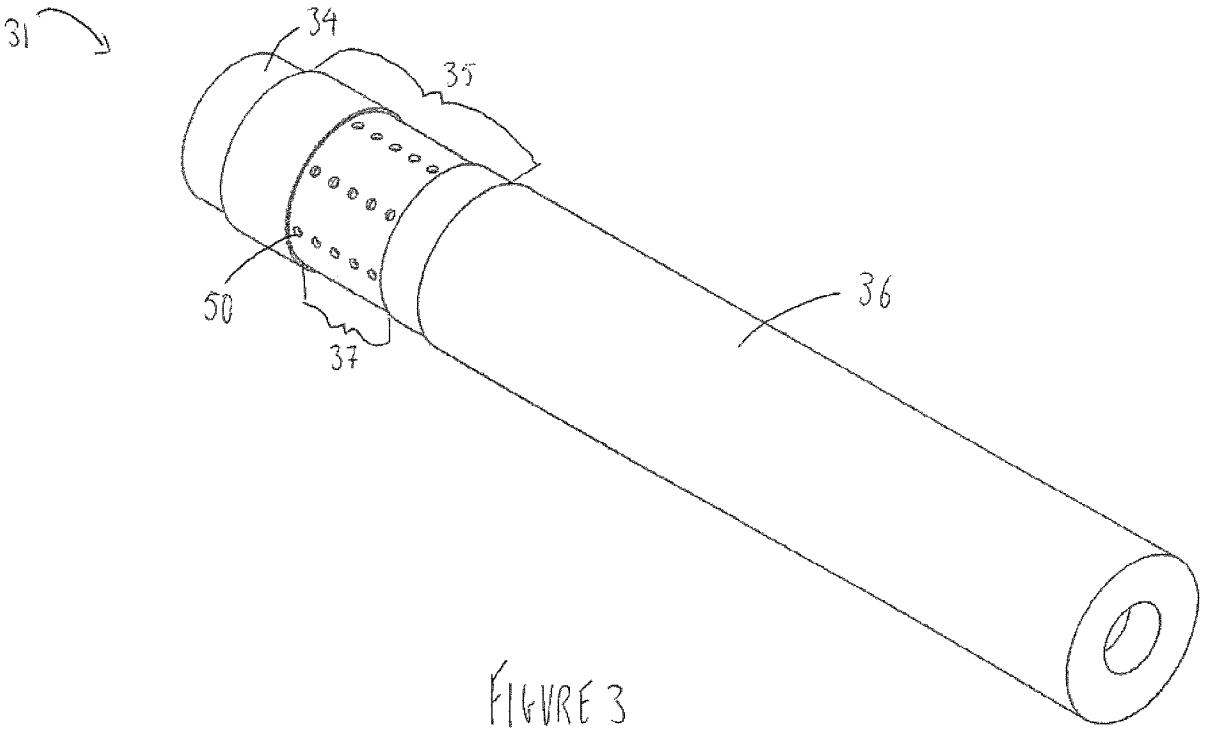
FIG. 3 is a perspective view of the pressure compensated housing of the MWD tool.

Referring now to FIG. 3 there is shown the generally tubular pressure compensated housing 31 of the motor subassembly 25 which may be made from a non-magnetic metal, for example, but not limited to, stainless steel, beryllium, copper, or stainless steel alloys. The pressure compensated housing 31 comprises three sections: a body section 36 that encloses the pulse generating motor and gearbox 23; a sleeve receiving section 35 that encloses the pressure compensation device 48 and receives the sleeve 70; and a cap receiving section 34 that encloses the seal 54 and receives retention cap 32. The sleeve receiving section 35 has a reduced diameter compared to the diameter of the body section 36 and the cap receiving section 34 has a reduced diameter compared to the diameter of the sleeve receiving section 35. The sleeve receiving section 35 includes an aperture area 37 comprising the plurality of primary apertures 50. The aperture area 37 has a reduced diameter compared to the diameter of the non-aperture area of the sleeve receiving section 35. When the sleeve 70 is positioned on the sleeve receiving section 35 of the pressure compensated housing 31, a drilling fluid expansion chamber 38 is created between the external surface of the aperture area 37 and the internal surface of the sleeve 70 as shown in FIG. 5.

Figure 4:
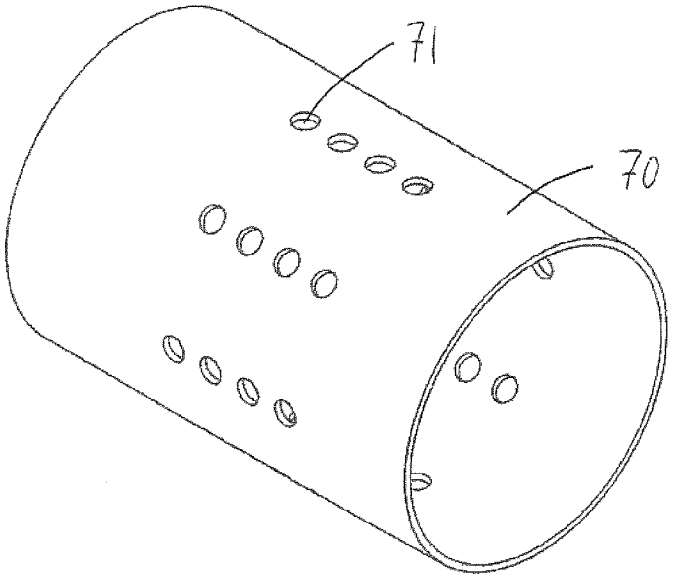
FIG. 4 is a perspective view of the sleeve of the MWD tool.

FIG. 4 shows the generally thin walled tubular sleeve 70 with the plurality of secondary apertures 71 therethrough. The sleeve 70 may be made from the same material as the pressure compensated housing 31 or it may be made of a different material, for example but not limited to: injection moulded plastic or ceramic; machined non-magnetic metal, plastic or ceramic; or cast non-magnetic metal or ceramic. The material used for the sleeve 70 may be selected to be wear resistant, but less expensive than the material chosen for the pressure compensated housing 31.

During assembly of the pulser assembly 26, the sleeve 70 is slid onto the pressure compensated housing 31 over the cap receiving section 34 and onto the sleeve receiving section 35 until the uphole end of the sleeve 70 abuts the downhole end of the body section 36. Retention cap 32 is then positioned on the cap receiving section 34 to hold the sleeve 70 in place on the pressure compensated housing 31. The external surface of the cap receiving section 34 may be threaded (not shown) to engage a correspondingly threaded internal surface (not shown) of the retention cap 32 to removably secure the retention cap 32 in place on the cap receiving section 34. Other means of removably securing the retention cap 32 onto the cap receiving section 34, as would be known by a person of skill in the art, may be utilized in alternative embodiments. When mated, the outer surface of the retention cap 32, the outer surface of the sleeve 70, and the outer surface of the body section 36 of the pressure compensated housing 31 are all flush as shown in FIG. 2. This beneficially presents a smooth outer surface of the pulser assembly 26 for drilling mud to flow along. In alternative embodiments the sleeve 70 may have a larger diameter than the diameter of the body section 36 and/or the retention cap 32, such that the outer surface of the sleeve 70 protrudes above the outer surface of the pressure compensated housing 31 and/or the retention cap 32, which may beneficially extend the wear life of the pressure compensated housing 31. In further alternative embodiments the sleeve 70 may have a smaller diameter than the diameter of the body section 36 and/or the retention cap 32. The retention cap 32 may fixedly secure the sleeve 70 between the body section 36 and the retention cap 32. Alternatively the sleeve 70 may be free to rotate on the pressure compensated housing 31, which may beneficially reduce localized flow erosion caused by the drilling mud.

In an alternative embodiment (not shown) the retention cap 32 or other retention device may be integrated in the sleeve 70 as a unitary body. The internal surface of the downhole end of this unitary cap and sleeve may have a threaded section which corresponds to an externally threaded surface of cap receiving section 34 of the pressure compensated housing 31 and the sleeve 70 may be removable mated with the receiving section 34. Alternative means of mating the sleeve with the pressure compensated housing as would be known in the art may also be used.

In the embodiment shown in FIG. 5, the secondary apertures 71 of the sleeve 70 are offset from the primary apertures 50 of the pressure compensated housing 31 so that the externally flowing drilling mud is prevented from directly impinging on the primary apertures 50. Instead, the drilling mud flows along the external surface of sleeve 70 and through secondary apertures 71 into the longitudinally offset drilling fluid expansion chamber 38. The drilling mud then flows through primary apertures 50 into the longitudinally offset drilling fluid pressure compensation chamber 49 and comes into contact with membrane 51 of the pressure compensation device 48. The drilling mud flow path from the external environment to the drilling fluid pressure compensation chamber 49 (as depicted by the arrows in FIG. 5) changes direction, restricts and expands numerous times before the mud contacts the membrane 51. Offsetting of the secondary apertures 71 as well as provision of the drilling fluid expansion chamber 38 and the drilling fluid pressure compensation chamber 49 therefore creates a more complex flow path for the drilling mud before the mud reaches the membrane 51 of the pressure compensation device 48. This complex flow path may beneficially protect and increase the life span of the membrane 51 by reducing the velocity of drilling mud impinging on the membrane 51, reducing the chance of sharp objects coming into contact with the membrane 51, as well as reducing the impingement of pre-heat steam on the membrane 51, which can thermally shock the membrane 51 to cause cracking failure.

The secondary apertures 71 are arranged in a linear pattern and spaced such that each secondary aperture 71 is positioned between two adjacent underlying primary apertures 50. In alternative embodiments (not shown), a different offset pattern may be utilized, for example the whole line of secondary apertures 71 may be offset and spaced between underlying lines of primary apertures 50, or the secondary apertures 71 may be offset in more than one direction from the underlying primary apertures 50, such as in a zigzag, helical or spiral pattern. In further alternative embodiments (not shown), the secondary and primary apertures 71, 50 need not be completely offset and at least a portion of one or more of the secondary apertures 71 may align with at least a portion of one or more of the underlying primary apertures 50. When at least a portion of the primary and secondary apertures align, the sleeve 70 can be positioned directly on the pressure compensated housing 31 without the need for the drilling fluid expansion chamber 38 as the drilling mud can flow through the aligned primary and secondary apertures 50, 71. The primary and secondary apertures 50, 71 may be of any shape or size, for example, circular, oval, egg-shaped, square etc., and dimensioned to allow adequate drilling mud to come into contact with the membrane 51 of the pressure compensation device 48 for pressure equalization with the internal lubrication liquid. The shape and/or size of the primary apertures 50 may differ from the shape and/or size of the secondary apertures 71 and a variety of shapes and sizes may be utilized. The innovative aspects of the invention apply equally in embodiments such as these.

The sleeve 70 may beneficially protect the primary apertures 50 of the pressure compensated housing 31 from wear and erosion. Without the sleeve 70, primary apertures 50 are typically high wear sites which erode quickly due to their exposure to external drilling mud and excessive wear may result in the primary apertures 50 exhibiting an elongated (in the direction of mud flow) curved depression on their downhole edge. Sleeve 70 protects primary apertures 50 from wear caused by the external drilling mud which may beneficially increase the longevity of the pressure compensated housing 31. Although secondary apertures 71 may become worn over time, the sleeve 70 is a non-structural and cheaper component compared to the more expensive pressure compensated housing 31. It may be beneficially easier, cheaper and more time efficient to replace the externally positioned sleeve 70 rather than having to replace the pressure compensated housing 31. Replacement or servicing of a worn pressure compensated housing 31 requires removal of the internal components of the pulser assembly 26 such as the pulse generating motor and gearbox 23, driveshaft 24, and pressure compensation device 48. In contrast, removal and replacement of a worn sleeve 70 can be easily carried out without the need for removing internal components of the pulser assembly 26. As such, sleeve replacement turnaround time is typically faster than replacement of the pressure compensated housing 31. In addition, replacement of the sleeve 70 typically does not need to be carried out by a skilled technician.

In an alternative embodiment (not shown) the secondary apertures 71 need not be present on a separate sleeve 70 that is positioned over the pressure compensated housing 31 and instead may be part of the pressure compensated housing 31. In this embodiment, the pressure compensated housing 31 comprises an interior wall including primary apertures 50 therethrough and an overlying exterior wall including secondary apertures 71 therethrough. The secondary apertures 71 may be offset from the underlying primary apertures 50 with a gap provided between the exterior wall and the interior wall to form drilling fluid expansion chamber 38. Alternatively, at least a portion of one or more of the secondary apertures 71 may align with at least a portion of the underlying primary aperture 50. When there is alignment of at least a portion of the primary and secondary aperture 50, 71, the exterior wall may be positioned directly on the interior wall (such as press-fitted together) as drilling mud can flow through the aligned primary and secondary apertures 50, 71. The innovative aspects of the invention apply equally in embodiments such as these.

While the present invention is illustrated by description of several embodiments and while the illustrative embodiments are described in detail, it is not the intention of the applicant to restrict or in any way limit the scope of the appended claims to such detail. Additional advantages and modifications within the scope of the appended claims will readily appear to those sufficed in the art. For example, while the MWD tool 20 has generally been described as being orientated with the pressure pulse generator 30 at the downhole end of the tool, the tool may be orientated with the pressure pulse generator 30 at the uphole end of the tool. The innovative aspects of the invention apply equally in embodiments such as these.

The invention in its broader aspects is therefore not limited to the specific details, representative apparatus and methods, and illustrative examples shown and described. Accordingly, departures may be made from such details without departing from the spirit or scope of the general concept.

The invention claimed is:

1. A fluid pressure pulse generating apparatus for downhole drilling comprising a fluid pressure pulse generator and a pulser assembly, the pulser assembly comprising:

(a) a pulser assembly housing;

(b) a motor and a driveshaft enclosed by the pulser assembly housing, the driveshaft extending from the motor out of the pulser assembly housing and coupling with the fluid pressure pulse generator;

(c) a seal surrounding a portion of the driveshaft and configured to seal against the driveshaft to prevent drilling fluid from entering the pulser assembly housing and lubrication liquid from leaving the pulser assembly housing when the fluid pressure pulse generating apparatus is positioned downhole; and (d) a pressure compensation device enclosed by the pulser assembly housing and comprising a pressure compensation mechanism providing a fluid barrier between the lubricating liquid on a first side of the pressure compensation mechanism and the drilling fluid on an opposed second side of the pressure compensation mechanism when the fluid pressure pulse generating apparatus is positioned downhole, the pressure compensation mechanism configured to allow pressure equalization between the lubrication liquid on the first side and the drilling fluid on the second side of the pressure compensation mechanism, wherein the pulser assembly housing comprises an interior wall with a plurality of primary apertures therethrough and an exterior wall with a plurality of secondary apertures therethrough, the exterior wall overlying the interior wall, and the primary apertures and the secondary apertures being in fluid communication with the pressure compensation mechanism such that the drilling fluid flows through the primary and secondary apertures and contacts the second side of the pressure compensation mechanism when the fluid pressure pulse generating apparatus is positioned downhole.

2. The apparatus of claim 1, wherein there is a gap between the interior wall and the exterior wall.

3. The apparatus of claim 2, wherein the secondary apertures are offset from the underlying primary apertures.

4. The apparatus of claim 1, further comprising a longitudinally extending drilling fluid chamber between the interior wall and the second side of the pressure compensation mechanism, the drilling fluid chamber being in fluid communication with the plurality of primary and secondary apertures.

5. The apparatus of claim 1, wherein the pulser assembly housing comprises: a pressure compensated housing comprising the interior wall; and a sleeve surrounding the interior wall and comprising the exterior wall.

6. The apparatus of claim 5, wherein the sleeve is removable from the pressure compensated housing.

7. The apparatus of claim 5, further comprising a retention device for retaining the sleeve in position on the pressure compensated housing.

8. The apparatus of claim 7, wherein the retention device is a cap configured to mate with the pressure compensated housing.

9. The apparatus of claim 8, wherein the cap comprises a threaded internal surface and the pressure compensated housing comprises a correspondingly threaded external surface portion for removably securing the cap on the pressure compensated housing.

10. The apparatus of claim 7, wherein the retention device is incorporated in the sleeve.

11. The apparatus of claim 10, wherein a portion of the sleeve comprises a threaded internal surface and a portion of the pressure compensated housing comprises a correspondingly threaded external surface for retaining the sleeve on the pressure compensated housing.

12. The apparatus of claim 5, wherein a diameter of the sleeve is greater than a diameter of the pressure compensated housing such that an external surface of the sleeve projects above an external surface of the pressure compensated housing.

13. The apparatus of claim 5, wherein the pressure compensated housing comprises a body section and a sleeve receiving section that receives the sleeve thereon, the sleeve receiving section including the plurality of primary apertures therethrough and being of reduced diameter compared to the body section such that the external surface of the sleeve is flush with the external surface of the body section.

14. The apparatus of claim 13, wherein the sleeve receiving section comprises an aperture area including the plurality of primary apertures therethrough and a non-aperture area, the aperture area being of reduced diameter compared to the non aperture area.

15. The apparatus of claim 13, further comprising a cap for retaining the sleeve in position over the sleeve receiving section and wherein the pressure compensated housing further comprises a cap receiving section that receives the cap, the cap receiving section being of reduced diameter compared to the body section such that the external surface of the cap is flush with the external surface of the body section.

16. The apparatus of claim 15, wherein the cap comprises a threaded internal surface and the cap receiving section comprises a correspondingly threaded external surface for securing the cap on the pressure compensated housing.

17. A pulser assembly housing for a pulser assembly of a fluid pressure pulse generating apparatus, the pulser assembly housing configured to enclose a pressure compensation device comprising a pressure compensation mechanism providing a fluid barrier between lubricating liquid on a first side of the pressure compensation mechanism and drilling fluid on an opposed second side of the pressure compensation mechanism when the fluid pressure pulse generating apparatus is positioned downhole, the pulser assembly housing comprising an interior wall with a plurality of primary apertures therethrough and an exterior wall with a plurality of secondary apertures therethrough, wherein the exterior wall overlies the interior wall and the primary apertures and the secondary apertures are in fluid communication such that the drilling fluid flows through the primary and secondary apertures and contacts the second side of the pressure compensation mechanism when the fluid pressure pulse generating apparatus is positioned downhole to allow pressure equalization between the lubrication liquid on the first side and the drilling fluid on the second side of the pressure compensation mechanism, wherein there is a gap between the interior wall and the exterior wall.

18. The pulser assembly housing of claim 17, wherein the secondary apertures are offset from the underlying primary apertures.

19. A pulser assembly housing for a pulser assembly of a fluid pressure pulse generating apparatus, the pulser assembly housing configured to enclose a pressure compensation device comprising a pressure compensation mechanism providing a fluid barrier between lubricating liquid on a first side of the pressure compensation mechanism and drilling fluid on an opposed second side of the pressure compensation mechanism when the fluid pressure pulse generating apparatus is positioned downhole, the pulser assembly housing comprising a pressure compensated housing comprising an interior wall; and a sleeve surrounding the interior wall, wherein the interior wall has a plurality of primary apertures therethrough and the sleeve has a plurality of secondary apertures therethrough, wherein the sleeve overlies the interior wall and the primary apertures and the secondary apertures are in fluid communication such that the drilling fluid flows through the primary and secondary apertures and contacts the second side of the pressure compensation mechanism when the fluid pressure pulse generating apparatus is positioned downhole to allow pressure equalization between the lubrication liquid on the first side and the drilling fluid on the second side of the pressure compensation mechanism.

20. The pulser assembly housing of claim 19, wherein the sleeve is removable from the pressure compensated housing.

21. The pulser assembly housing of claim 19, further comprising a retention device for retaining the sleeve in position on the pressure compensated housing.

22. The pulser assembly housing of claim 21, wherein the retention device is a cap configured to mate with the pressure compensated housing.

23. The pulser assembly housing of claim 22, wherein the cap comprises a threaded internal surface and the pressure compensated housing comprises a correspondingly threaded external surface portion for removably securing the cap on the pressure compensated housing.

24. The pulser assembly housing of claim 21, wherein the retention device is incorporated in the sleeve.

25. The pulser assembly housing of claim 24, wherein a portion of the sleeve comprises a threaded internal surface and a portion of the pressure compensated housing comprises a correspondingly threaded external surface for retaining the sleeve on the pressure compensated housing.

26. The pulser assembly housing of claim 19, wherein a diameter of the sleeve is greater than a diameter of the pressure compensated housing such that an external surface of the sleeve projects above an external surface of the pressure compensated housing.

27. The pulser assembly housing of claim 19, wherein the pressure compensated housing comprises a body section and a sleeve receiving section that receives the sleeve thereon, the sleeve receiving section including the plurality of primary apertures therethrough and being of reduced diameter compared to the body section such that the external surface of the sleeve is flush with the external surface of the body section.

28. The pulser assembly housing of claim 27, wherein the sleeve receiving section comprises an aperture area including the plurality of primary apertures therethrough and a non-aperture area, the aperture area being of reduced diameter compared to the non-aperture area.

29. The pulser assembly housing of claim 27, wherein the pressure compensated housing further comprises a cap receiving section for receiving a cap to retain the sleeve in position over the sleeve receiving section, the cap receiving section being of reduced diameter compared to the body section such that the external surface of the cap is flush with the external surface of the body section when the cap is received on the cap receiving section.

30. The pulser assembly housing of claim 29, wherein the cap receiving section comprises a threaded external surface that corresponds with a threaded internal surface of the cap for securing the cap on the pressure compensated housing.

31. The pulser assembly housing of claim 19, wherein there is a gap between the interior wall and the sleeve.

32. The pulser assembly housing of claim 19, wherein the secondary apertures are offset from the underlying primary apertures.

33. A sleeve for surrounding a portion of a housing of a pulser assembly of a fluid pressure pulse generating apparatus, the housing having a plurality of housing apertures therethrough, wherein the sleeve comprises a tubular walled body with a plurality of sleeve apertures therethrough whereby the housing apertures and the sleeve apertures are in fluid communication when the sleeve is positioned on the housing, wherein a portion of the sleeve comprises a threaded internal surface for engaging a correspondingly threaded external surface portion of the housing to removably retain the sleeve on the housing.

* * * * *